United States Patent [19]

Morrison

[11] 4,133,628

[45] Jan. 9, 1979

[54] VAPOR INJECTOR FOR FUEL COMBUSTION SYSTEM

[76] Inventor: Charles F. Morrison, 25 Pearl St., Malden, Mass. 02148

[21] Appl. No.: 834,179

[22] Filed: Sep. 19, 1977

Related U.S. Application Data

[63] Continuation-in-part of Ser. No. 771,718, Feb. 24, 1977, which is a continuation-in-part of Ser. No. 664,967, Mar. 8, 1976, Pat. No. 4,009,984.

[51] Int. Cl.[2] ..... F23J 7/00

[52] U.S. Cl. ..... 431/4; 123/25 R; 261/18 A

[58] Field of Search ..... 431/4, 190, 3, 126; 137/3, 423; 261/18 B, 18 A; 123/25 R

[56] References Cited

U.S. PATENT DOCUMENTS

| | | | |
|---|---|---|---|
| 3,924,648 | 12/1975 | Etter | 137/3 |
| 4,014,637 | 3/1977 | Schena | 431/4 |

*Primary Examiner*—Edward G. Favors
*Attorney, Agent, or Firm*—Richard L. Stevens

[57] ABSTRACT

A vapor injector for use with a fuel combustion system which system has an air intake assembly and a combustion area. The vaporizer includes a platform floating on a reservoir of water. A tube extends from the platform into the reservoir a predetermined distance, the lower end of the tube is slotted. The distance the tube extends into the reservoir remains constant regardless of the level of the reservoir. The upstream end of the tube communicates directly with ambient. The vaporizer is connected to the air intake assembly. A negative pressure is applied to the vapor chamber and a saturated air stream flows from the chamber and into the combustion area.

12 Claims, 4 Drawing Figures

VAPOR INJECTOR FOR FUEL COMBUSTION SYSTEM

CROSS-REFERENCE TO RELATED APPLICATIONS

This application is a continuation-in-part application of my application Ser. No. 771,718 filed Feb. 24, 1977 which in turn is a continuation-in-part application of my earlier application Ser. No. 664,967 filed Mar. 8, 1976 and now U.S. Pat. No. 4,009,984.

BACKGROUND AND BRIEF SUMMARY OF THE INVENTION

In fossil fuel burners it is well known that the addition of water vapor enhances the combustion efficiency. Introduction of water vapor may be solely by positive pressure, U.S. Pat. No. 3,724,429; negative pressure (vacuum), U.S. Pat. No. 3,107,657; or both positive and negative pressure, U.S. Pat. No. 3,862,819. In this last-mentioned patent, the concept of water vapor introduced into a combustion chamber is applied to central heating units, such as oil heaters. This patent provides a fuel catalyzer which has a first conduit from the high pressure side of the fan associated with the oil burner to a position below a reservoir of water. A second conduit transports water vapor to the downstream side of the fan from a chamber above the reservoir.

My invention disclosed in U.S. Pat. No. 4,009,984 comprised a vacuum-tight housing, a reservoir of water in the housing, and a constant vapor chamber disposed above the reservoir. A vacuum was created in the vapor chamber, which resulted in an airflow being drawn into the housing and through the reservoir. The airflow entrained metered amounts of highly vaporized water molecules which flowed into the vapor chamber and ultimately into the combustion chamber.

In Ser. No. 771,718 an apparatus and method are provided wherein the size of the vapor chamber may be varied and uniform flow of air through the reservoir and into the vacuum chamber is achieved.

In that invention a tube is adjustably secured to and depending from a free floating platform. The platform floats on a reservoir of water. The tube extends into the water and is characterized by a plurality of perforations. The perforations are immersed in the reservoir. Flow passages are formed externally of the tube whereby air is drawn through the flow passages, the water and ultimately into the vacuum chamber as a vapor stream.

Further work in this area has indicated that of the dual concept employed, namely the constant vapor chamber and constant dimensions of the tube within the reservoir, the latter appears to be more important.

The present invention comprises a housing having a reservoir of water therein. A depending tube is structured to provide a uniform flow of air, the tube preferably having a plurality of slots in the lower portion thereof. The tube is secured to a free-floating platform, the upper portion of the tube communicates directly with the ambient. The vapor chamber is formed above the reservoir and is defined by the surface of the reservoir and the inner surface of the upper portion of the housing.

DESCRIPTION OF THE PREFERRED EMBODIMENT

In my prior applications the specific arrangement of the vapor injector to the oil burner is described in detail and is not repeated here, it being understood that the same or a similar arrangement could be used for purposes of the present invention.

Figure 1:
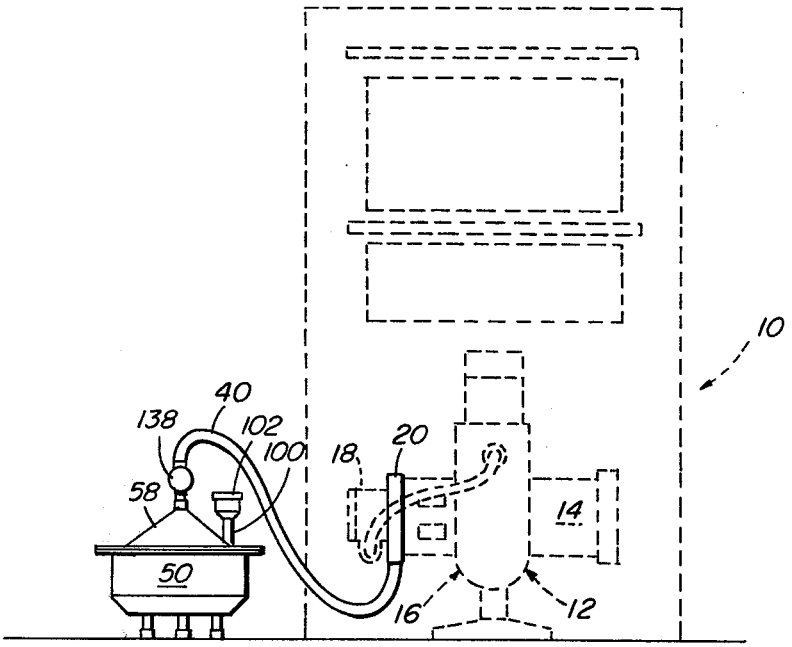
FIG. 1 is a front schematic view of a conventional oil burner in combination with an embodiment of the invention.

Referring to FIG. 1, a conventional furnace 10 and oil burner 12 are shown in dotted lines. The oil burner typically comprises a motor 14, a fan housing and air intake assembly 16 and an oil pump 18. A vapor injector 50 communicates with a vacuum pump 20 via conduit 40.

Figure 2:
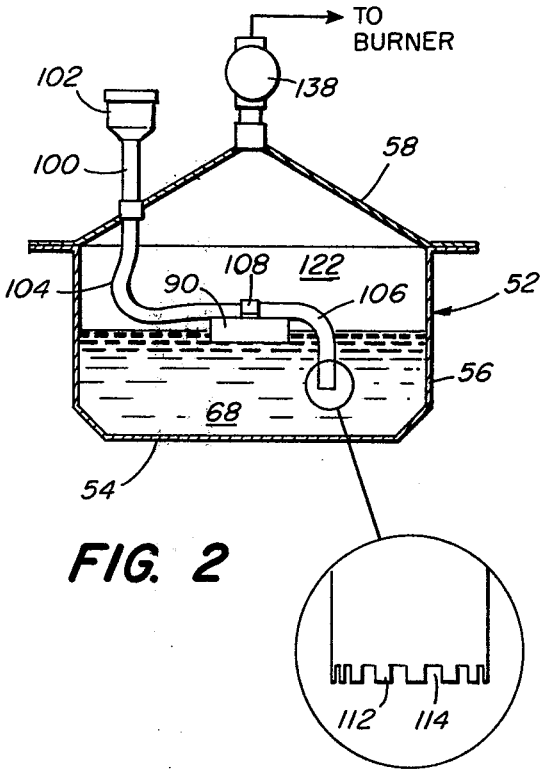
FIG. 2 is a front elevation of a float and tube assembly of the invention.

Referring to FIG. 2, the vapor injector 50 is shown in greater detail and comprises a cylindrical-shaped housing 52 having a floor 54, a circular wall 56 and cone-shaped cover 58 sealingly secured to the wall 56 of the housing.

The housing 52 has a reservoir of water 68 which carries a free-floating platform 90 of any suitable bouyant material.

Secured to the cover is a tube 100 which includes an air filter 102 at its upper end. The tube is preferably of a rigid material such as high density polyethylene. A flexible tube 104 is sealingly secured to the tube 100. An L-shaped rigid tube 106, such as high density polyethylene, is secured to the platform 90 such as by a clamp 108. The dependent portion of the tube which is immersed in the reservoir is characterized by a plurality of projections 112 defining slots 114 therebetween. A vapor chamber 122 is defined by the upper surface of the reservoir 68, the wall 56 and the cover 58.

The operation of the invention is described in reference to the introduction of a saturated air stream into the combustion area. However, it is to be understood that it may be used in any application wherein it is desired to meet a particle into a fluid stream at a constant rate for any purpose.

In the operation of the invention the platform 90 is disposed in the housing 52 and floats on the surface of the reservoir 68. If at any time the water in the reservoir 68 appreciably drops an automatic off/on valving assembly, such as described in detail in the aforementioned applications, may be used to replenish the water supply. The tube 106 extends into the reservoir 68.

Once the tube 106 has been secured by the clamp 108 the relationship between the depth of the tube in the reservoir and the level of water in the reservoir is constant. The burner is actuated and calibrated with the flow rate of the saturated air stream controlled by the valve 138.

The burner requirements, i.e. a larger burner requiring a greater flow of saturated air stream, determines the size of the tube and depth and width of the projections 112.

The calibration of a particular system is described in my aforementioned patent and application and is not repeated in detail here.

When the valve 138 is opened, a vacuum is created in the chamber 122. This creates a pressure differential between the chamber 122 and the ambient environment about the vapor injector 50. This differential results in the air flowing through the tubes 100, 104 and 106, the slots 114 in the tube 106, the reservoir 68 and into the vacuum chamber 122 forming a saturated air stream. This stream flows into conduit 40 and into the main stream of combustion air and finally in the combustion area.

Figure 3:
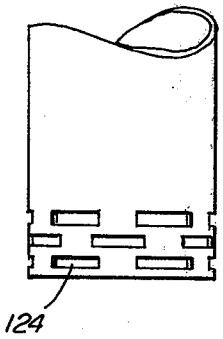
FIG. 3 is a schematic illustration of an alternative embodiment of the invention.

In its simplest embodiment a tube without perforations may be used. However it is preferred to use a tube with slots as described to control both the size of the water particles which will enter the saturated air stream and their uniformity. As shown in FIG. 3, perforations 124 are used and may be nonuniform and of any geometric configuration. The perforations may increase in size extending toward the lower end of the depending tube to provide for uniformity, the variation in size accounting for the change in pressure along the length of the tube as it extends into the water. Also a combination of slots and perforations are within the scope of my invention.

In some installations it was found that the vacuum created in the vaporizer by the burner operation per se was not sufficient to effect maximum vapor transfer into the ignition chamber. One way to overcome this program was disclosed in my aforementioned patent, U.S. Pat. No. 4,009,984, wherein a vacuum pump was placed in the air intake assembly. In the preferred embodiment the vacuum pump 20 is used. In an alternative embodiment, to create a pressure differential, a blower or fan 108 is placed on the tube 100. The fan 108 may be used alone or in combination with the pump 20.

Figure 4:
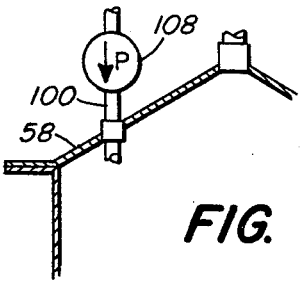
FIG. 4 is a front fragmentary view of a further alternative embodiment of my invention.

More particularly referring to FIG. 4, the fan 108 is secured to the tube 100 to provide for the introduction of an air stream into the tube 100 and through the tubes 104 and 106, slots 114 in the tube 106, the reservoir 68 and into the vapor chamber 122 forming the saturated air stream. The fan creates a pressure that is greater than the ambient pressure thereby increasing the pressure differential between the ambient and the vapor chamber 122.

Accordingly, my invention embodies the vapor injector used alone, or used in combination with either a vacuum pump or with a baffling device to limit the normal air intake as described in my aforementioned applications, or with a blower or fan; or any combination thereof.

Having described my invention what I now claim is:

1. An apparatus for adding water vapor to a fossil fuel combustion system which system has an air intake assembly for introducing a flow of air into the combustion area of the combustion system which comprises:

(a) a housing;

(b) a reservoir disposed within the housing;

(c) a free-floating platform on the surface of the reservoir;

(d) means to form a vapor chamber above the reservoir;

(e) conduit means secured to the platform and extending a fixed distance into the reservoir and having an upper and a lower end, the lower end in the reservoir and characterized by a plurality of slots for the flow of air therethrough; said fixed distance remaining constant regardless of the level of the water in the reservoir; the upper end of the conduit means isolated from the vacuum chamber; and in communication with ambient;

(f) means to create a pressure differential between the ambient about the housing and the vapor chamber to draw air through the water and into the vacuum chamber forming a saturated air stream which air stream flows through a conduit and into the combustion area of the fuel combustion system.

2. The apparatus of claim 1 wherein the housing is a cylindrical housing having a cover sealingly secured thereto.

3. The apparatus of claim 1 wherein the conduit means includes at its lower end a plurality of uniform projections, the projections defining uniform slots therebetween.

4. The apparatus of claim 1 wherein the lower end of the conduit means is characterized by a plurality of perforations therein for the flow of air therethrough.

5. The apparatus of claim 1 wherein the means to create a pressure differential includes means to create a vacuum in the vacuum chamber which means includes:

a vacuum pump secured to the air intake assembly.

6. The apparatus of claim 1 wherein the means to create a pressure differential includes:

means to maintain the pressure of the air flowing through the conduit means greater than ambient.

7. The apparatus of claim 6 wherein the means to create a pressure differential includes:

a vacuum pump secured to the air intake assembly.

8. A method for introducing a saturated air stream into the combustion chamber of an oil burner or the like wherein a housing is provided having a free-floating platform on the surface of a reservoir within the housing, a vapor chamber defined above the reservoir, and a conduit having an upper and a lower end, the upper end of the tube communicating with ambient and the lower end of the tube being received within the reservoir, which method comprises:

maintaining a pressure differential between the vapor chamber and the ambient;

flowing an air stream from the upper end to the lower end of the tube;

passing the air stream uniformly through the lower end of the tube, resulting in water droplets entering the vapor chamber at a uniform rate and of a uniform size;

maintaining the depth of the tube in the reservoir the same regardless of the level of the water in the reservoir; and, flowing the saturated air stream in the vapor chamber into the combustion area.

9. The method of claim 8 which includes flowing the air stream through a plurality of slots formed in the lower end of the tube.

10. The method of claim 8 which includes creating a vacuum in the vapor chamber to effect the movement of the saturated air into the combustion chamber.

11. The method of claim 8 which includes maintaining pressure in the conduit at a pressure greater than ambient.

12. The method of claim 11 which includes creating a vacuum in the vapor chamber.

* * * * *